US006843398B2

(12) United States Patent
Zion

(10) Patent No.: US 6,843,398 B2
(45) Date of Patent: Jan. 18, 2005

(54) RUCKSACK

(76) Inventor: Isaac Zion, 6 Yehuda HeHasid Street, Tel Aviv (IL)

( * ) Notice: Subject to any disclaimer, the term of this patent is extended or adjusted under 35 U.S.C. 154(b) by 32 days.

(21) Appl. No.: 10/305,935

(22) Filed: Nov. 27, 2002

(65) Prior Publication Data

US 2004/0099704 A1 May 27, 2004

(51) Int. Cl.[7] ..... A45F 4/02

(52) U.S. Cl. ..... 224/576; 224/155; 224/261; 224/633; 297/118

(58) Field of Search ..... 224/153, 155, 224/156, 261, 576, 633; 190/8, 127; 297/118, 129; 5/419, 633, 643

(56) References Cited

U.S. PATENT DOCUMENTS

| | | | | | |
|---|---|---|---|---|---|
| 1,447,486 | A | * | 3/1923 | Schafer et al. | 297/351 |
| 2,857,957 | A | * | 10/1958 | Gay | 297/114 |
| 3,307,758 | A | * | 3/1967 | Platt | 224/155 |
| D210,579 | S | * | 3/1968 | Hehn | D6/374 |
| 4,410,214 | A | * | 10/1983 | Geschwender | 297/118 |
| 4,530,451 | A | * | 7/1985 | Hamilton | 224/155 |
| 5,131,575 | A | | 7/1992 | Charest | |
| 5,588,570 | A | * | 12/1996 | Zirbel | 224/155 |
| 5,676,293 | A | * | 10/1997 | Farris | 224/576 |
| 5,819,999 | A | * | 10/1998 | Tennant | 224/155 |
| 5,927,798 | A | * | 7/1999 | Ahn | 297/129 |
| 6,145,716 | A | * | 11/2000 | Caicedo | 224/155 |
| 6,547,110 | B2 | * | 4/2003 | O'Hare | 224/155 |

FOREIGN PATENT DOCUMENTS

| | | | | |
|---|---|---|---|---|
| FR | 2 608 392 | | 12/1986 | |
| FR | 2608392 | | 6/1988 | |
| JP | 5-300808 | A * | 11/1993 | 224/153 |

* cited by examiner

*Primary Examiner*—Gary E. Elkins
(74) *Attorney, Agent, or Firm*—Cohen, Pontani, Lieberman & Pavane

(57) ABSTRACT

A knapsack or rucksack for providing leaning support for a wearer. The inventive rucksack or knapsack includes a back-wall and a bottom-wall formed of a rigid frame of a generally L-shape wherein a first leg of the frame supports the back-wall and a second leg supports the bottom-wall. The L-shape frame allows a user to lean against the back-wall of the rucksack or knapsack when the bottom-wall is on a support surface such as a floor.

17 Claims, 5 Drawing Sheets

RUCKSACK

BACKGROUND OF THE INVENTION

The present invention relates to rucksacks or knapsacks of the type carried on the back of travelers.

The prime object of the invention is to improve the structure of conventional rucksacks so that it becomes useful for the traveler as a back-rest.

SUMMARY OF THE INVENTION

To this end there is provided according to the present invention a rucksack comprising a back-wall and a bottom-wall characterized by a rigid frame of a generally L-shape having a first leg supporting the back-wall and a second leg supporting the bottom-wall thereof.

Preferably, there is provided a flap foldable between a first position wherein the flap overlaps the back-wall exteriorly, and a second position wherein the flap extends in the plane of and in a direction away from the bottom wall, thus enabling the rucksack to serve as a back-rest for one sitting of the flap in the second position thereof.

Optionally the rucksack may include an anti-weather cap configured to cover the head of the user in said sitting position.

BRIEF DESCRIPTION OF THE DRAWINGS

These and additional features of construction and advantages of the invention will be better understood in the light of the ensuing description of two preferred embodiments thereof, given by way of example only, with reference to the accompanying drawings, wherein.

DETAILED DESCRIPTION OF THE PREFERRED EMBODIMENTS

Figure 1:
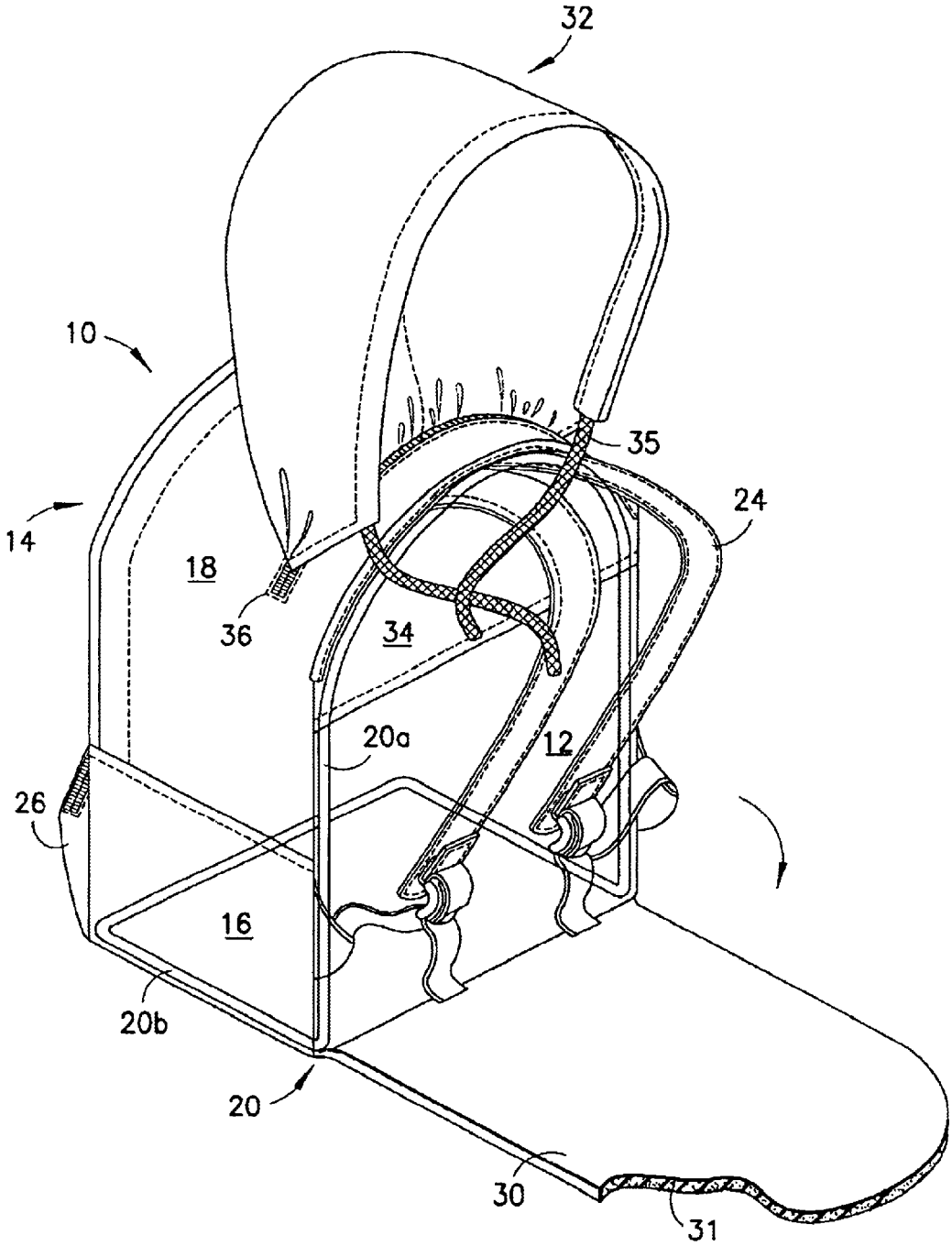
- FIG. 1 is general schematic view of a rucksack featuring the principles of the present invention, in its final, ready-to-use state.
Figure 2:
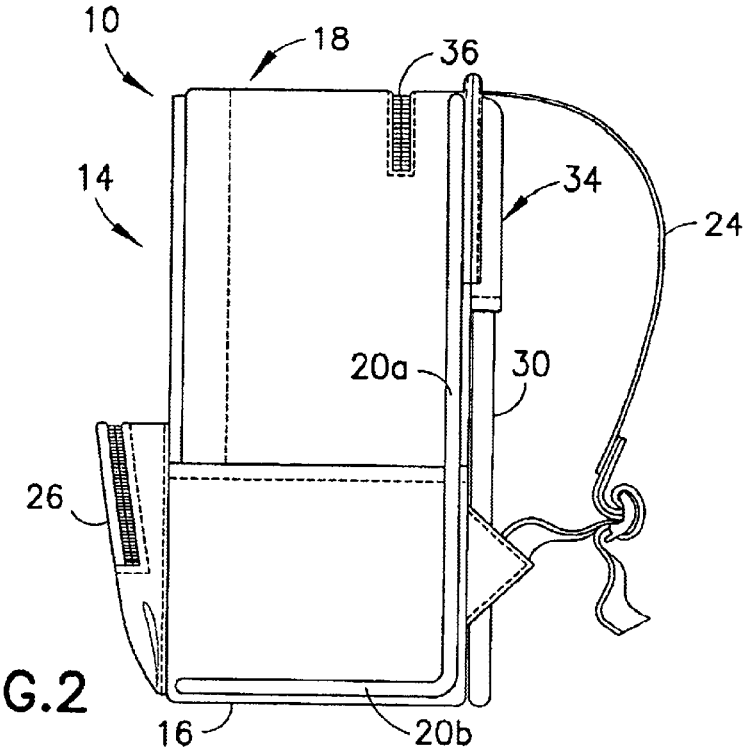
FIG. 2 is a side view of the rucksack in the normal usage state.

As generally shown in FIG. 1, the rucksack generally denoted 10, which may otherwise be of any conventional design and shape, namely comprising a back-wall 12, a front-wall 14, a bottom-wall 16 and side- and top-wall 18 extending therearound.

Shoulder straps 24 and any other auxiliary components such as pocket 26 are included as in any conventional design.

However, the rucksack 10 is uniquely provided with a stiffening frame designated 20 preferably made of aluminum pipe. The frame 20 is generally L-shaped, the upright leg 20*a* thereof extends along the corner formed between the back-wall 12 and the side- and top-wall 18. The horizontal leg 20*b* of the L-shaped frame 20 extends the corner between the bottom-wall 16, the side-wall and the front-wall 14.

The frame can be simply inserted into the rucksack and secured by several stitches (not shown). It may also be overall covered by a cloth sheath.

The rucksack 10 further differs from conventional designs by being provided with a flap 30, made of canvas stuffed with upholstering material 31, can be positioned to extend in the plane and as an extension of the bottom-wall 16, as shown.

According to an additional aspect of the invention there is provided a cap 32 with tying strips 33. The cap is normally stored within a pocket closed by zipper 36.

Figure 3:
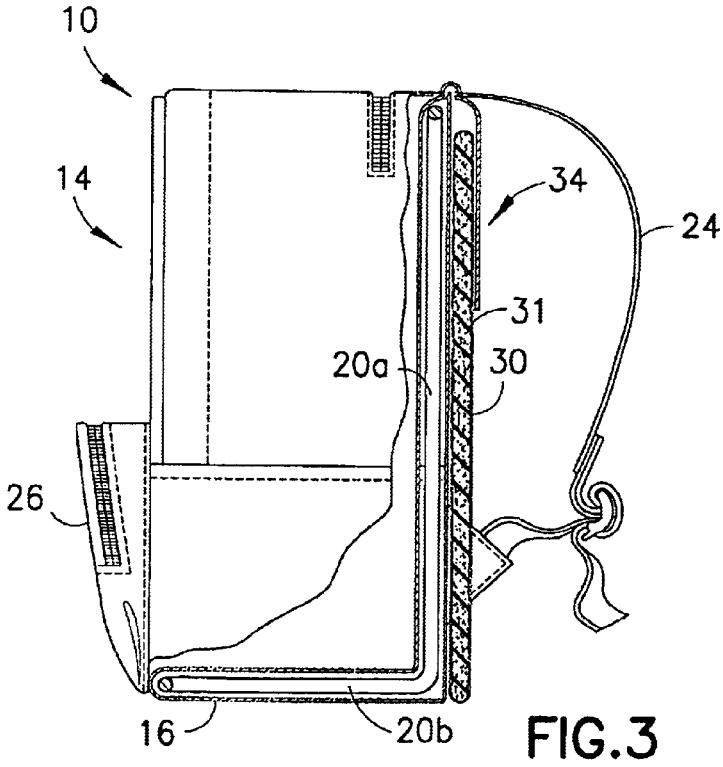
FIG. 3 is a partly sectional view of FIG. 2.
Figure 4:
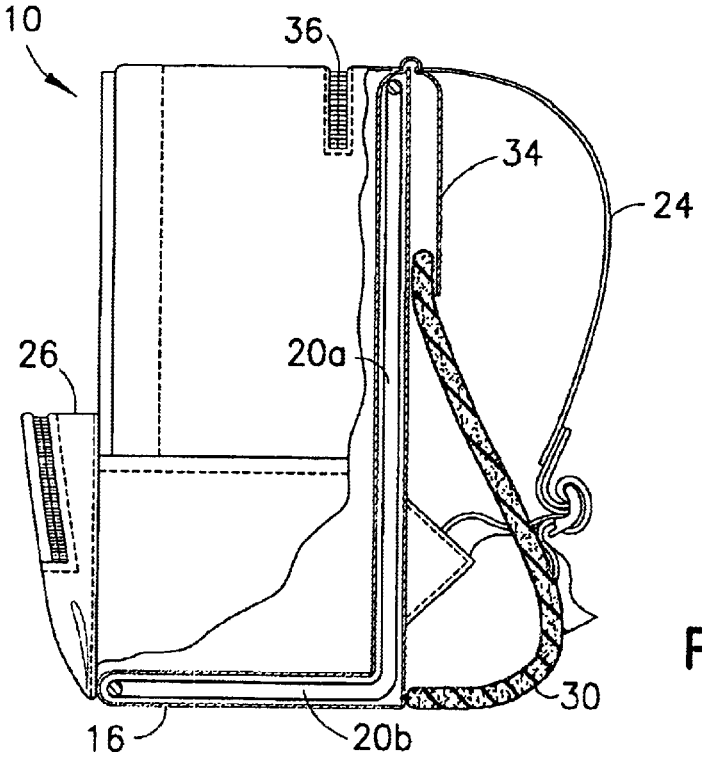
FIG. 4 shows a first stage of converting the rucksack of FIG. 3 into a back-rest.
Figure 5:
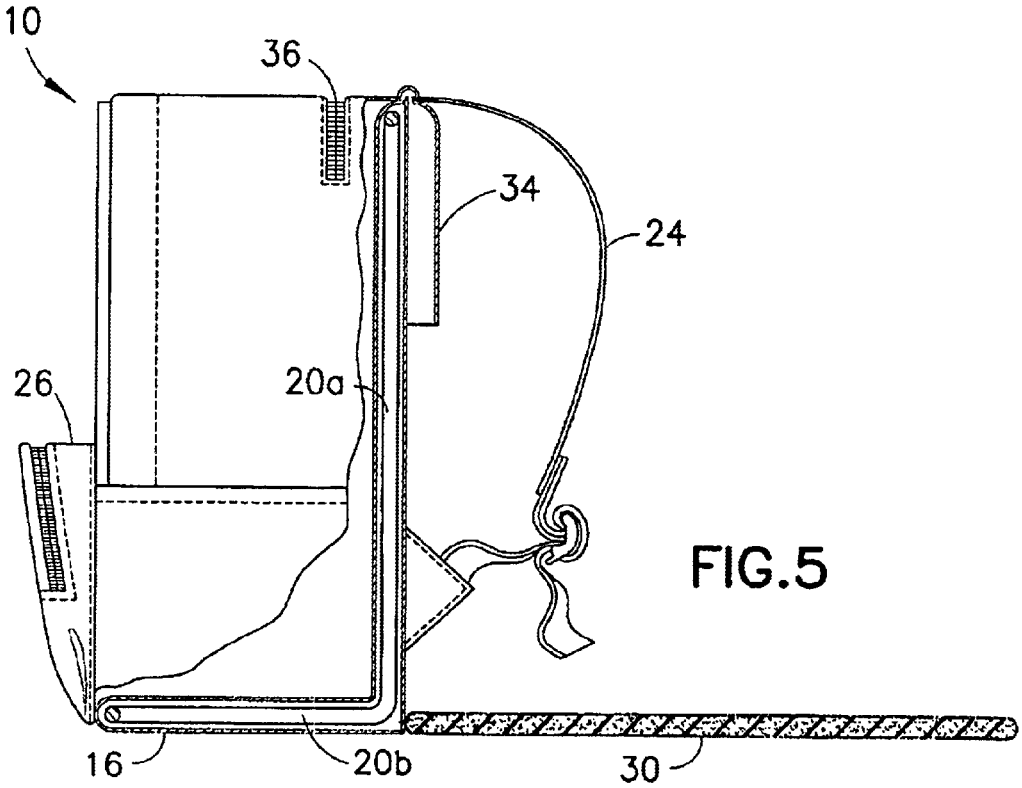
FIG. 5 shows the rucksack in its back-rest serving position.

In more detail now and with reference to FIGS. 2–6, it will be readily understood that the flap is normally partly stored within a pocket 34 prepared for that purpose (FIG. 3). When needed for use, the flap 30 is extracted from the pocket 34 (FIG. 4) and spread into the horizontal position (FIG. 5).

Figure 6:
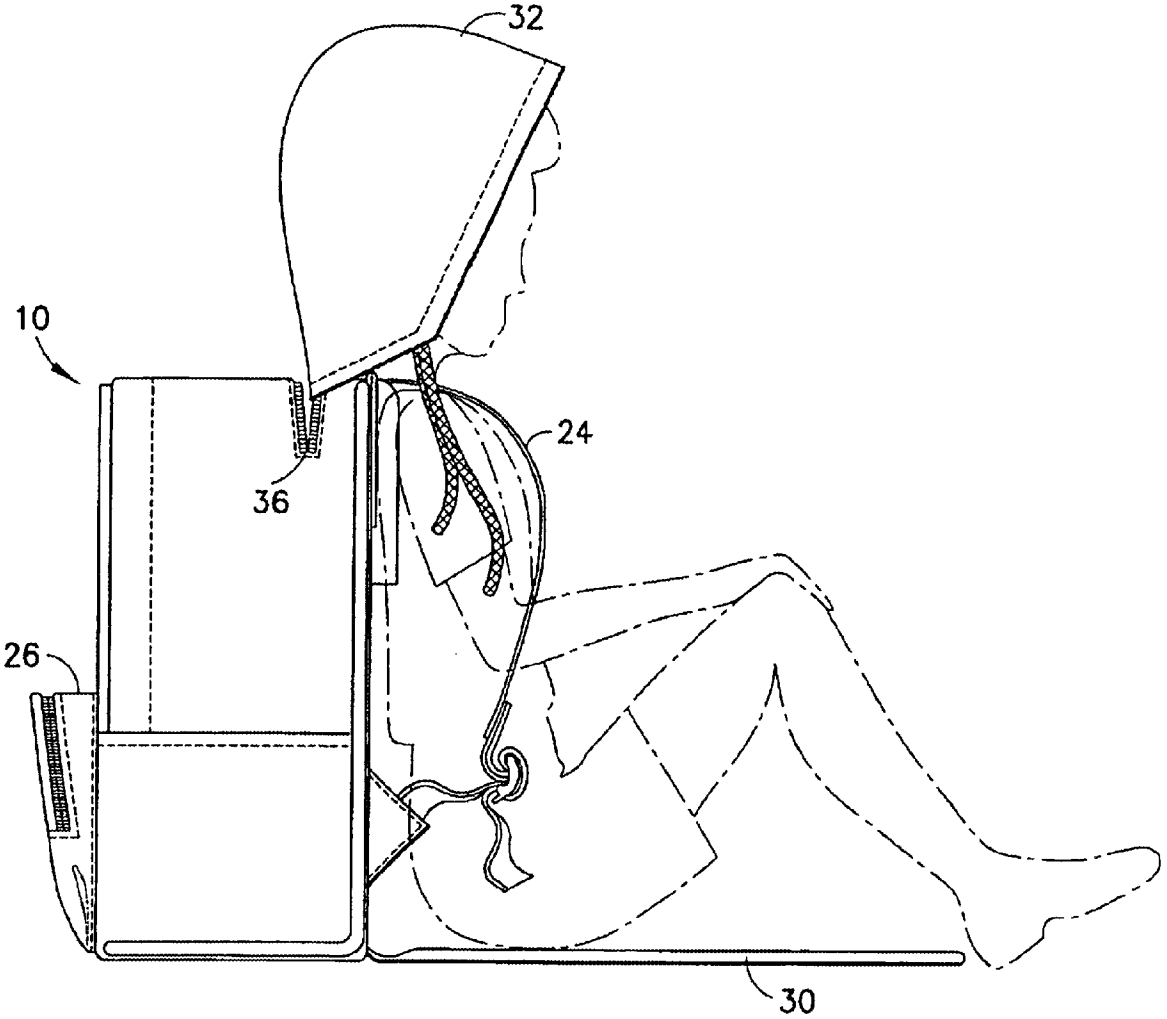
FIG. 6 illustrates the use of the rucksacks of FIG. 5 as a block-rest and, in addition the retrieval and use of an anti-weather cap.

FIG. 6 vividly shows the mode use of the rucksack 10 as a firm back-rest while the user comfortably sits on the flap 30 thereby avoiding the rucksack from "escaping" backwards under the force exerted thereagainst by the back of the user.

Figure 7:
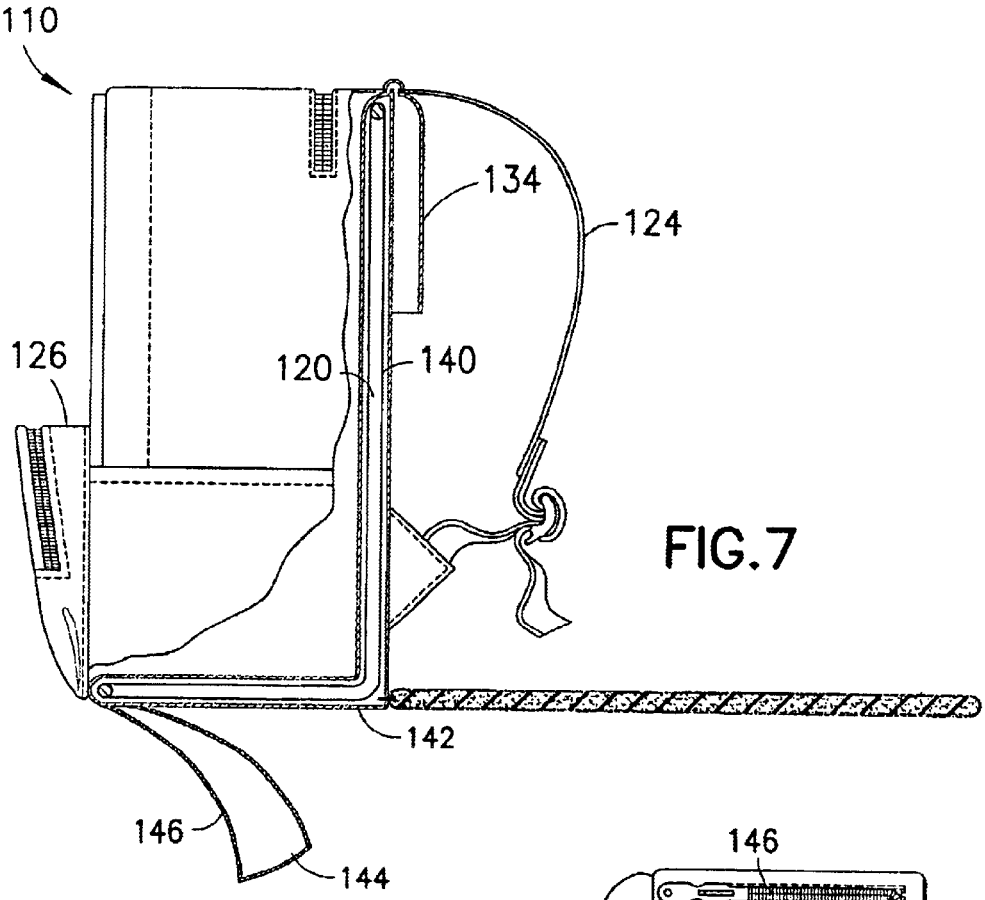
FIG. 7 is a modification of the rucksack wherein the frame and flap are made separable from the rucksack.
Figure 8:
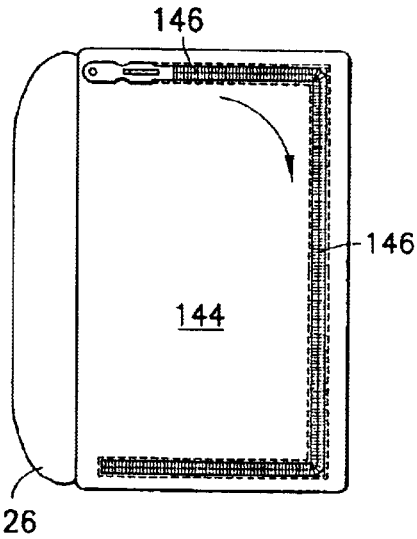
FIG. 8 is a bottom view of FIG. 7.
Figure 9:
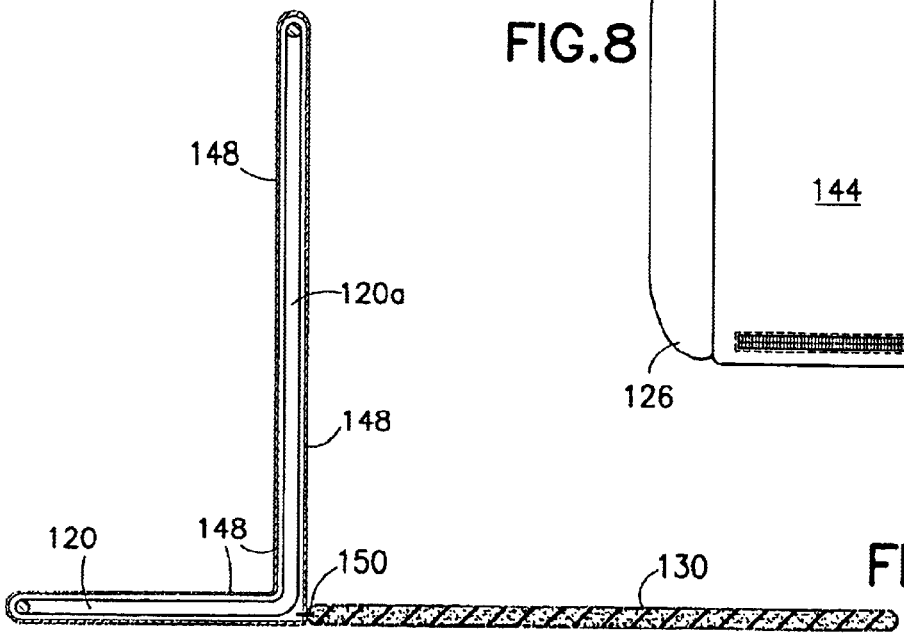
FIG. 9 shows the frame and flap used in the embodiment of FIG. 7.

The embodiment of FIGS. 7–9 is designed to allow the frame-and-flap system to be removed or separated from the rucksack. Hence, rucksack 110 is provided with a double-wall structure and annexed to both the back-wall 140 and the bottom-wall 142, the latter being closeable by flap 144 with zipper 146 at three sides thereof.

The frame 120 with upright section 120*a* and bottom section 120*b* is enclosed within a common cloth sheath 148 to which the flap 130 is sewn along edge 150.

Thus provided is a neat and effective solution for travelers seeking a comfortable rest under field conditions at no extra cost of, e.g., carrying a choir or stool for that purpose.

While the above description contains many specificities, these should not be construed as limitations on the scope of the invention, but rather as exemplification of the preferred embodiments. Those skilled in the art will envision other possible variations that are within its scope. Accordingly, the scope of the invention should be determined not by the embodiments illustrated, but by the appended claims and their legal equivalents.

What is claimed is:

1. A rucksack having a bottom-wall lying in a plane and a back-wall, said rucksack comprising:

a generally L-shaped rigid frame, said frame being disposed within said rucksack and having
an exterior,
a first leg supporting said back-wall, and
a second leg supporting said bottom-wall thereof;

a pocket disposed on said back-wall, on said exterior of said rucksack; and a flap, foldable between a first position wherein said flap overlaps said exterior of said back-wall, and a second position wherein said flap extends in said plane of and in a direction away from said bottom wall, thus enabling said rucksack to serve as a back-rest for one sitting on said flap in said second position thereof, said flap being insertable into said pocket.

2. The rucksack of claim 1 further characterized by a flap foldable between a first position wherein the flap overlaps the back-wall exteriorly, and a second position wherein the flap extends in the plane of and in a direction away from the bottom wall, thus enabling the rucksack to serve as a back-rest for one sitting of the flap in the second position thereof.

3. The rucksack of claim 2 wherein the frame is integrally formed of bent-over metal pipe sections, both the first leg and the second leg being U-shaped.

4. The rucksack of claim 3 wherein the pipe sections forming the first leg extend along three sides of the back wall and the pipe sections forming the second leg extend along three sides of the bottom-wall.

5. The rucksack of claim 4 wherein the frame and flap are removable from the rucksack.

6. The rucksack of claim 5 wherein the first leg of the frame is insertable into a sheath provided at the back-wall.

7. The rucksack of claim 6 wherein the second leg of the frame is insertable into a sheath provided at the bottom-wall.

8. The rucksack of claim 2 further comprising an anti-weather cap configured to cover the head of the user in said sitting position.

9. The rucksack of claim 8 wherein the cap is insertable into a pocket provided at a top portion of the rucksack.

10. The rucksack of claim 1 wherein the flap is made of canvas stuffed with upholstering material.

11. A rucksack having a bottom-wall lying in a plane and a back-wall, said rucksack comprising:

a generally L-shaped rigid frame, said frame being disposed within said rucksack and having
an exterior,
a first leg supporting said back-wall, and
a second leg supporting said bottom-wall thereof;

a pocket disposed on said back-wall, on said exterior of said rucksack; and a flap, foldable between a first position wherein said flap overlaps said exterior of said back-wall, and a second position wherein said flap extends in said plane of and in a direction away from said bottom wall, thus enabling said rucksack to serve as a back-rest for one sitting on said flap in said second position thereof, said flap being insertable into said pocket;

wherein said frame is integrally formed of bent-over metal pipe sections, both said first leg and said second leg being U-shaped; and wherein said pipe sections forming said first leg extend along three sides of said back-wall and are secured thereto, and said pipe sections forming said second leg extend along three sides of said bottom-wall; and are secured thereto.

12. The rucksack of claim 11 wherein the flap is made of canvas stuffed with upholstering material.

13. The rucksack of claim 11 wherein the frame and flap are removable from the rucksack.

14. The rucksack of claim 13 wherein the first leg of the frame is insertable into a sheath provided at the back-wall.

15. The rucksack of claim 14 wherein the second leg of the frame is insertable into a sheath provided at the bottom-wall.

16. The rucksack of claim 11 further comprising an anti-weather cap configured to cover the head of the user in said sitting position.

17. The rucksack of claim 16 wherein the cap is insertable into a pocket provided at a top portion of the rucksack.

* * * * *